US009216578B2

(12) United States Patent
Tamenaga et al.

(10) Patent No.: US 9,216,578 B2
(45) Date of Patent: Dec. 22, 2015

(54) LIQUID EJECTION HEAD

(71) Applicant: CANON KABUSHIKI KAISHA, Tokyo (JP)

(72) Inventors: Zentaro Tamenaga, Sagamihara (JP); Takuto Moriguchi, Kamakura (JP); Shuzo Iwanaga, Kawasaki (JP); Kazuhiro Yamada, Yokohama (JP); Takatsugu Moriya, Tokyo (JP); Akira Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/709,307

(22) Filed: May 11, 2015

(65) Prior Publication Data

US 2015/0328892 A1 Nov. 19, 2015

(30) Foreign Application Priority Data

May 13, 2014 (JP) ..... 2014-099418
Apr. 16, 2015 (JP) ..... 2015-084378

(51) Int. Cl.
*B41J 2/14* (2006.01)
*B41J 2/16* (2006.01)

(52) U.S. Cl.
CPC ..... *B41J 2/1433* (2013.01); *B41J 2002/14491* (2013.01)

(58) Field of Classification Search
CPC .. B41J 2/1433; B41J 2/14072; B41J 2/17526; B41J 2/155; B41J 2002/14491
See application file for complete search history.

(56) References Cited

U.S. PATENT DOCUMENTS 6,609,786 B1 8/2003 Silverbrook et al.
7,686,423 B2 * 3/2010 Sato et al. ..... 347/50
7,789,488 B2 * 9/2010 Mori ..... 347/50

FOREIGN PATENT DOCUMENTS

JP 2010-521343 A 6/2010

* cited by examiner

*Primary Examiner* — Juanita D Jackson
(74) *Attorney, Agent, or Firm* — Canon USA Inc. IP Division

(57) ABSTRACT

A liquid ejection head includes a recording element substrate including an electrode at a first side portion; an electrical wiring substrate having a wire line; a connecting portion connecting the electrode and the wire line; and a sealing material provided between the first side portion of the recording element substrate and the electrical wiring substrate. A first line and a second line are out of alignment in a direction along a side of the recording element substrate. The first line orthogonal to the side passes through a center of gravity of the recording element substrate. A second line passes through a center of a part covered with the sealing material and extends parallel to the first line. Of a part of the sealing material, a first area on the first line side has a larger volume than that of a second area opposite to the first line side.

20 Claims, 7 Drawing Sheets

LIQUID EJECTION HEAD

BACKGROUND OF THE INVENTION

1. Field of the Invention

The present invention relates to a liquid ejection head for ejecting liquid.

2. Description of the Related Art

Ink-jet (IJ) printers have recently been used not only for home printing but also for commercial printing, such as business printing and retail photo printing, and for industry printing, such as electronic circuit printing and panel display, and applications are spreading. Supporting high-speed printing is a strong requirement for IJ printer heads for use in commercial printing and industry printing. To meet the requirement, recording elements that generate energy for ejecting liquid ink are driven at high frequency, or a line head having a width larger than the width of a recording medium and having a large number of ejection ports is used.

PCT Japanese Translation Patent Publication No. 2010-521343 discloses a configuration of a long line head in which a plurality of recording element substrates are disposed in a staggered arrangement. The configuration disclosed in PCT Japanese Translation Patent Publication No. 2010-521343 achieves the size reduction of a head by disposing electrical wiring substrates only at a position facing first side portion of the recording element substrates. Examples of the electrical wiring substrates include a flexible printed circuit (FPC) and a tape automated bonding (TAB) circuit. The configuration including a plurality of recording element substrates sometimes use recording element substrates having a parallelogram planar shape to achieve the size reduction of the head and high-density printing.

The recording element substrates and the electrical wiring substrates are electrically connected using connecting members, such as bonding wires, to transmit and receive electrical power and electrical signals. The connecting members are generally sealed with a sealing member, such as a thermosetting resin, to prevent breakage due to an external force or corrosion due to liquid.

An invention disclosed in U.S. Pat. No. 6,609,786 provides a head module (unit) in which a recording element substrate and so on are mounted on an individual support member, and a plurality of the head modules are arranged in a line to form a long line head. The head modules disclosed in U.S. Pat. No. 6,609,786 have a rectangular planar shape. The head modules are inclined so that adjacent head modules are overlapped in a longitudinal direction and in a direction orthogonal thereto, thus achieving high density.

Of liquid ejection heads, recording element substrates having a parallelogram planar shape and the configuration in which at least first side portion of inclined recording element substrates, as disclosed in U.S. Pat. No. 6,609,786, is covered with a sealing member can cause relative misalignment due to cure shrinkage of the sealing member. The misalignment of the recording element substrates from proper positions can cause misalignment of the landing positions of ejected liquid, thus hindering good printing. This problem occurs not only in a line head having a plurality of recording element substrates, as disclosed in PCT Japanese Translation Patent Publication No. 2010-521343 and U.S. Pat. No. 6,609,786, but also in a compact liquid ejection head having only one recording element substrate that ejects liquid while moving, that is, a so-called serial head. In particular, a line head in which a plurality of recording element substrates are disposed, as disclosed in PCT Japanese Translation Patent Publication No. 2010-521343, causes the above problem in each of the recording element substrates and also a decrease in the ejection accuracy (landing accuracy) of liquid due to the decrease in the accuracy of the relative position of the recording element substrates. Using such liquid ejection heads in ink-jet printers would cause streaks and non-uniformity in an image formed by ejecting liquid, thus degrading the image quality. In particular, recent ink-jet printers form remarkably high-definition images and thus require eliminating even slight misalignment of the recording element substrates, which has not been a critical problem. Furthermore, in the configuration disclosed in PCT Japanese Translation Patent Publication No. 2010-521343, a plurality of recording element substrates are mounted on one long support structure, so that even one problem in the plurality of recording element substrate would make the entire head unavailable.

The configuration in which a plurality of independent head modules are provided, as disclosed in U.S. Pat. No. 6,609,786, also has the possibility that the positions of the recording element substrates in the individual head modules are misaligned variously. In such a case, the accuracy of the relative positions of all the recording element substrates cannot be increased unless the misalignment of the head modules is adjusted after the plurality of head modules are combined. Thus, its manufacturing process and adjusting work are complicated.

SUMMARY OF THE INVENTION

The present invention provides a liquid ejection head, for various shapes of recording element substrates, in which misalignment of the recording element substrates due to a sealing member can be reduced, and for a configuration having a plurality of recording element substrates, the accuracy of the relative positions of the recording element substrates can easily be adjusted.

A liquid ejection head includes a recording element substrate including an electrode at a first side portion; an electrical wiring substrate having a wire line; a connecting portion connecting the electrode of the recording element substrate and the wire line of the electrical wiring substrate; and a sealing material provided between the first side portion of the recording element substrate and the electrical wiring substrate so as to cover the connecting portion. A first line and a second line are out of alignment in a direction along a side of the recording element substrate adjacent to the first side portion. The first line passes through a center of gravity of the recording element substrate and is orthogonal to the side. A second line passes through a center of a part on the side covered with the sealing material and extends parallel to the first line. Of two areas of a part of the sealing material covering the first side portion of the recording element substrate, the two areas being divided by the second line, a first area on the first line side has a larger volume than that of a second area opposite to the first line side.

With this configuration, the connecting member for use in electrical connection is protected by the sealing member, and stresses applied to both sides of the center of gravity of the recording element substrate due to the cure shrinkage of the sealing member are equal, or the difference between the stresses applied to both sides is small. This can reduce generation of a rotational force about the center of gravity of the recording element substrate.

Further features of the present invention will become apparent from the following description of exemplary embodiments with reference to the attached drawings.

DESCRIPTION OF THE EMBODIMENTS

Embodiments of the present invention will be described hereinbelow with reference to the drawings.

First Embodiment

Figure 1A:
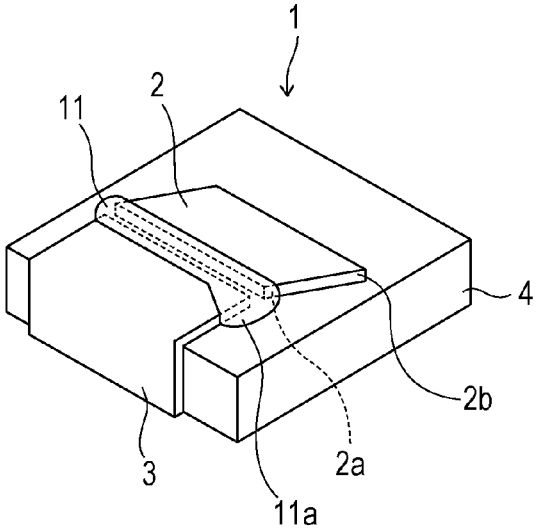
FIG. 1A is a perspective view of a liquid ejection head according to a first embodiment of the present invention.
Figure 1B:
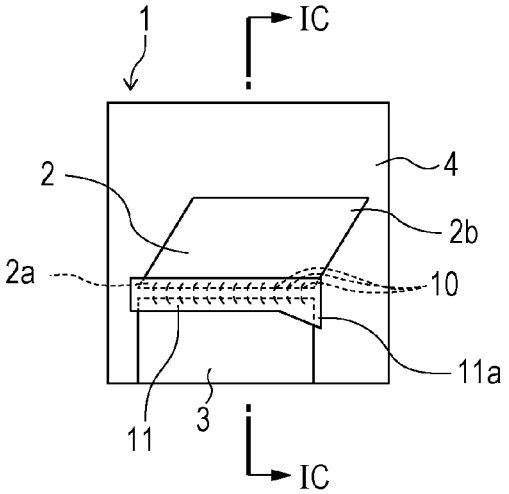
FIG. 1B is a plan view of the liquid ejection head.
Figure 1C:
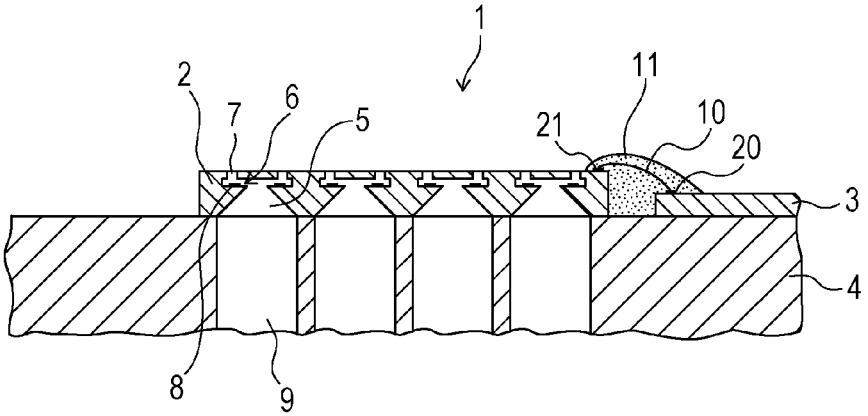
FIG. 1C is an enlarged cross-sectional view taken along line IC-IC of FIG. 1B.

Referring to FIGS. 1A to 1C, a liquid ejection head 1 according to a first embodiment of the present invention will be described. FIG. 1A is a perspective view of the liquid ejection head 1 of this embodiment, FIG. 1B is a plan view thereof, and FIG. 1C is a cross-sectional view taken along line IC-IC of FIG. 1B. The liquid ejection head 1 is a serial-type compact head including a recording element substrate 2, an electrical wiring substrate 3, and a support member 4. The recording element substrate 2 has a substantially parallelogram planar shape and includes supply paths 5 through which liquid, such as ink, is supplied, energy generating chambers 6 communicating with the supply paths 5, and ejection ports 7 communicating with the energy generating chambers 6 and open to the outside. The plurality of ejection ports 7 are disposed in a line. The energy generating chambers 6 each have a recording element 8 therein for generating energy for ejecting liquid. That is, the energy generating chambers 6 and the recording elements 8 are provided for the individual ejection ports 7. Examples of the recording elements 8 include a heating element that generates heat and a piezoelectric element that generates pressure. In this embodiment, the recording element substrate 2 includes a silicon substrate having the supply paths 5 and the recording elements 8 and an ejection-port formed member made of a resin material and having the ejection ports 7. The energy generating chambers 6 are formed at a joint portion between the substrate and the ejection-port formed member.

Such a recording element substrate 2 is mounted on the support member 4. The support member 4 has a plurality of lead-in paths 9 through which liquid flows. The lead-in paths 9 individually communicate with the supply paths 5 in the recording element substrate 2. The electrical wiring substrate 3 is disposed on the surface of the support member 4 in such a manner as to face a first side portion 2*a* of the recording element substrate 2. A side of the recording element substrate 2 adjacent to the first side portion 2*a* is opposed in proximity to a side of the electrical wiring substrate 3. An example of the electrical wiring substrate 3 is a flexible printed cable (FPC). Electrode terminals 20 of the electrical wiring substrate 3 and electrode terminals 21 of the recording element substrate 2 are electrically connected using connecting members 10, such as bonding wires or lead wires extending from the electrical wiring substrate 3. The electrode terminals 20 and the electrode terminals 21 are omitted in FIGS. 1A and 1B, and the connecting members 10 are omitted in FIG. 1A. The connecting members 10 extend between the recording element substrate 2 and the electrical wiring substrate 3. A sealing member (a sealing material) 11 made of a thermosetting resin for covering the connecting members 10 for protection is formed between the first side portion 2*a* of the recording element substrate 2 and part of the electrical wiring substrate 3. In this embodiment, a second side portion 2*b* of the recording element substrate 2 opposite to the first side portion 2*a* is exposed without being covered with resin or the like, such as the sealing member 11.

With such a configuration, in the liquid ejection head 1 of this embodiment, the energy generating chambers 6 are supplied with liquid from the lead-in paths 9 in the support member 4 via the supply paths 5 in the recording element substrate 2. When electrical driving signals are supplied from a control unit (not shown) to the recording elements 8 of the recording element substrate 2 via the electrical wiring substrate 3 and the connecting members 10, the recording elements 8 generate energy to cause the liquid in the energy generating chambers 6 to be ejected through the ejection ports 7 to the outside.

Next, the sealing member 11 of this embodiment will be described in detail. In this embodiment, the sealing member 11 has a rectangular planar shape having a protruding portion 11*a*. The technical significance of the sealing member 11 will be described.

The inventor analyzed the cause of misalignment of the recording element substrates 2 in the related-art liquid ejection heads 1 and obtained the following finding.

To achieve high density of the liquid ejection head 1, parallelogram recording element substrates 2 are provided in related art. The electrical wiring substrate 3 is opposed to the first side portion 2*a* of the recording element substrate 2. The electrode terminals 21 of the recording element substrate 2 and the electrode terminals 20 of the electrical wiring substrate 3 are connected using the connecting members 10, and the connecting members 10 are covered with the sealing member 11 for protection. Since the sealing member 11 is generally made of a thermosetting resin, the sealing member 11 is applied in such a manner as to cover the connecting members 10, is thereafter thermally cured, and is then cooled. At that time, the sealing member 11 shrinks, and stress due to the shrinkage is applied to the recording element substrate 2.

Figure 2:
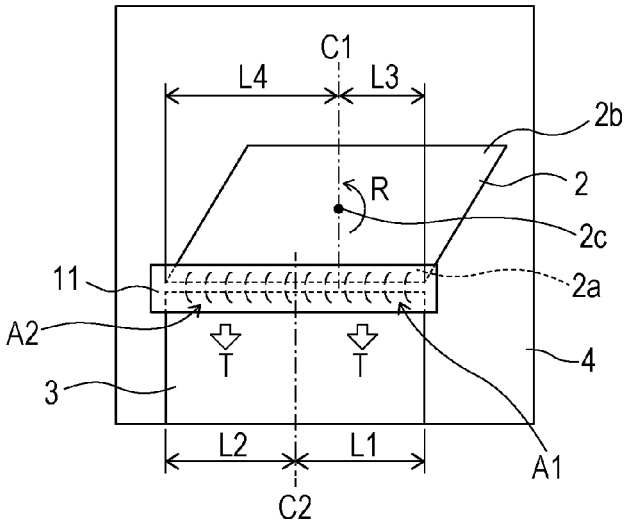
FIG. 2 is a plan view an example of a related art liquid ejection head.

FIG. 2 shows a comparative example of the present invention. As shown in FIG. 2, if the recording element substrate 2 has a parallelogram planar shape, a perpendicular C1 (a virtual line) extending through the center of gravity 2*c* of the recording element substrate 2 and intersecting at right angles to the side adjacent to the first side portion 2*a* and a sealing-member center line C2 are not aligned. That is, the lines C1 and C2 deviate from each other in the extending direction of the first side portion 2*a* (in the lateral direction of FIG. 2). The sealing-member center line C2 here is a line passing through the center of the side of the recording element substrate 2 adjacent to the first side portion 2*a* covered with the sealing member 11 and parallel to the perpendicular C1. A tensile stress T caused by the shrinkage of the sealing member 11 is generated substantially equally on both sides of the sealing-member center line C2. In other words, the sealing-member center line C2 is the center line of an area in which the stress due to the shrinkage of the sealing member 11 is generated. Since the sealing-member center line C2 and the perpendicular C1 are not aligned, the stress is not equally but unevenly applied to both side of the center of gravity 2*c* of the recording element substrate 2 (in the example of FIG. 2, a larger stress is applied to the left of the center of gravity 2*c* than to the right). Since the stress T acting on the recording element substrate 2 is not equal between the area on the left of the center of gravity 2*c* and the area on the right of the center of gravity 2*c*, a rotational force R about the center of gravity 2*c* is generated. This can cause the recording element substrate 2 to rotate on the support member 4 to cause misalignment.

In other words, if two areas A1 and A2 (an area having a length L1 and an area having a length L2), which are obtained by dividing the part of the sealing member 11 covering the first side portion 2*a* of the recording element substrate 2 by the sealing-member center line C2, have the same volume, the stress generated in the area A1 and the stress generated in the area A2 are equal. If the sealing-member center line C2 and the perpendicular C1 passing through the center of gravity 2*c* of the recording element substrate 2 are aligned, the area on the right of the center of gravity 2*c* of the recording element substrate 2, which receives the stress from the sealing member 11, and the area on the left of the center of gravity 2*c*, which receives the stress from the sealing member 11, have the same size. Accordingly, the stresses applied to both areas are equal, and no rotational force acts. However, if the sealing-member center line C2 and the perpendicular C1 are not aligned, the area on the right of the center of gravity 2*c* of the recording element substrate 2 (the area of length L3), which receives the stress from the sealing member 11, and the area on the left of the center of gravity 2*c* (the area of length L4), which receives the stress from the sealing member 11, differ in size. In the examples shown in FIGS. 2 and 3, the area of length L3 is smaller than the area of length L4. The magnitudes of stresses applied to the two areas differ depending on the difference in size between the two areas. The difference between the stresses acting on the right and left of the center of gravity 2*c* causes the rotational force R.

A large misalignment caused by the rotation of the recording element substrate 2 and so on will decrease the accuracy of the landing positions of liquid ejected from the liquid ejection head 1. Using this liquid ejection head 1 in an ink-jet printer results in a low degree of recording accuracy of liquid ejection.

Figure 3:
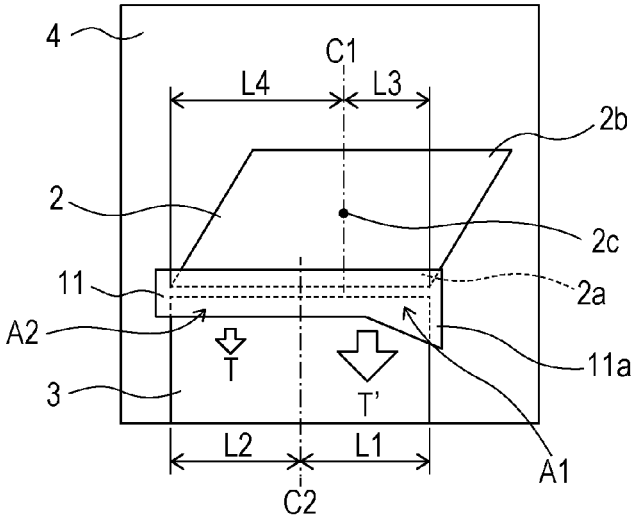
FIG. 3 is an explanatory diagram illustrating the action of the liquid ejection head shown in FIGS. 1A to 1C.

In this embodiment, the rotational force R is reduced by using the sealing member 11 having an asymmetrical planar shape on the premise that the sealing member 11 is formed in such a manner as to cover an area including the perpendicular C1. Specifically, as shown in FIG. 3, of the two areas on both sides of the sealing-member center line C2 passing through the center of the part of the sealing member 11 covering the first side portion 2*a* of the recording element substrate 2 and extending along the side thereof and parallel to the perpendicular C1, the area A1 through which the perpendicular C1 passes has a larger volume than the area A2 through which the perpendicular C1 does not pass. In this embodiment, the difference in volume is achieved by providing the protruding portion 11*a* in the area A1, with the length L1 of the area A1 and the length L2 of the area A2 kept equal. This causes a tensile stress T' generated in the area A1 to be larger than the tensile stress T generated in the area A2. This balances the stress acting on the area on the left of the center of gravity 2*c* and the stress acting on the area on the right of the center of gravity 2*c* in the recording element substrate 2.

That is, the sealing member 11 is formed such that the volumes of the area A1 and the area A2 covering the first side portion 2*a* of the recording element substrate 2 differ so that the stress T' acting on the area A1 is larger than the stress T acting on the area A2, with the sealing-member center line C2 at its center. Thus, the stress acting on one smaller area (the area of length L3) of the recording element substrate 2 and the stress acting on the other larger area (the area of length L4), with the center of gravity 2*c* of the recording element substrate 2 as its center, become substantially equal. As a result, a rotational force about the center of gravity 2*c* does not act on the recording element substrate 2. In this way, misalignment due to the rotation of the recording element substrate 2 is reduced. The difference between the volumes of the areas A1 and A2 may be set so that the stresses acting on the area of length L3 and the area of length L4 are substantially equal in consideration of the difference in size between the smaller area and the other larger area of the recording element substrate 2 (the difference between the length L3 and the length L4). In the present invention, the stresses acting on the area of length L3 and the area of length L4 do not need to be exactly equal; the rotational force R in the case where the area A1 is provided may be smaller than the rotational force R without the area A1. A reverse rotational force (clockwise rotation in FIGS. 2 and 3) may be generated if the rotational force R is small.

Figure 4:
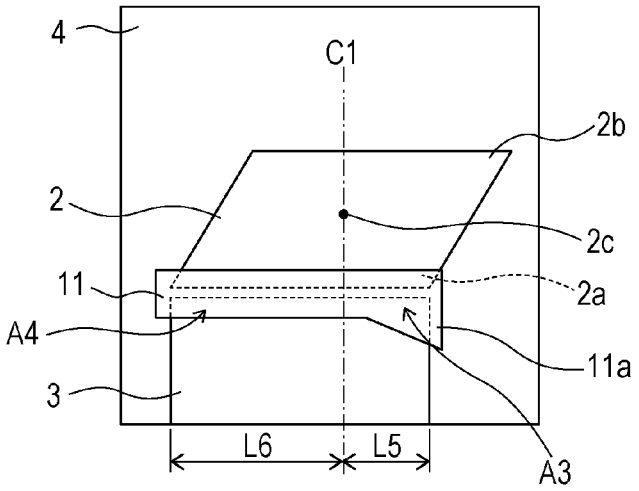
FIG. 4 is another explanatory diagram illustrating the action of the liquid ejection head shown in FIGS. 1A to 1C.

For the configuration for restraining the rotation of the recording element substrate 2 due to a stress caused by the cure shrinkage of the sealing member 11, as described above, the part of the sealing member 11 covering the first side portion 2*a* of the recording element substrate 2 may be divided into two areas by the perpendicular C1, as shown in FIG. 4. That is, if the part of the sealing member 11 covering the first side portion 2*a* of the recording element substrate 2 is divided into two areas A3 and A4 (an area of length L5 and an area of length L6) by the perpendicular C1 passing through the center of gravity 2*c* of the recording element substrate 2, the volumes of the two areas A3 and A4 may be equal. If the two areas A3 and A4 of the part of the sealing member 11 covering the first side portion 2*a* of the recording element substrate 2, divided by the perpendicular C1, have the same volume, the same magnitude of stress acts on both sides of the center of gravity 2*c* of the recording element substrate 2 during the cure shrinkage of the sealing member 11. Thus, a rotational force about the center of gravity 2*c* is not generated in the recording element substrate 2. However, even if the volume of the area A3 and the volume of the area A4 are not exactly equal and if the difference therebetween is small, the effect of reducing the misalignment due to the rotation of the recording element substrate 2 can be obtained to some extent because a rotational force about the center of gravity 2*c* is small.

As described above, this embodiment has the advantage of reducing misalignment due to the rotation by adjusting the volumes of the two areas A1 and A2 of the sealing member 11 covering the first side portion 2*a* of the recording element substrate 2. This can reduce the misalignment of the landing positions of liquid ejected from the liquid ejection head 1. The use of the liquid ejection head 1 in an ink-jet printer allows good printing and provides high recording quality.

In the liquid ejection head 1 of this embodiment, the support member 4 needs a low coefficient of linear expansion, high rigidity, and high corrosion resistance to ink. Thus, aluminum oxide (alumina) or silicon carbide may be used as a material for the support member 4. However, a material for the support member 4 is not limited thereto in the present invention; the support member 4 may be made of a resin material. With the resin material, a low coefficient of linear expansion can be achieved by containing a filler therein.

The sealing member 11 is made of, for example, a thermosetting epoxy resin, and mainly protects the connecting members 10 mechanically and chemically, specifically, prevents damage from an external force or corrosion due to liquid, such as ink. In some embodiments of the present invention, a plurality of kinds of sealing member may be used. An example of the configuration has a sealing member with a relatively low viscosity under the connecting members 10 and a sealing member with a relatively higher viscosity on the connecting members 10.

The recording element substrate 2 may not be a parallelogram, as shown in FIGS. 1A and 1B, but may have any planar shape, such as a square, a rectangle, a trapezoid, a trapezium, or a polygon other than a rectangle. However, the advantage of this embodiment is given in the configuration in which perpendicular C1 and the sealing-member center line C2 are not aligned. This embodiment is not very advantageous in the configuration in which the perpendicular C1 passing through the center of gravity 2*c* of the recording element substrate 2 and orthogonal to the side adjacent to the first side portion 2*a* and the sealing-member center line C2 coincide, because little rotational force R is generated in the recording element substrate 2. In an embodiment of the present invention, at least the side adjacent to the first side portion 2*a* may be substantially a straight line.

Figure 5A:
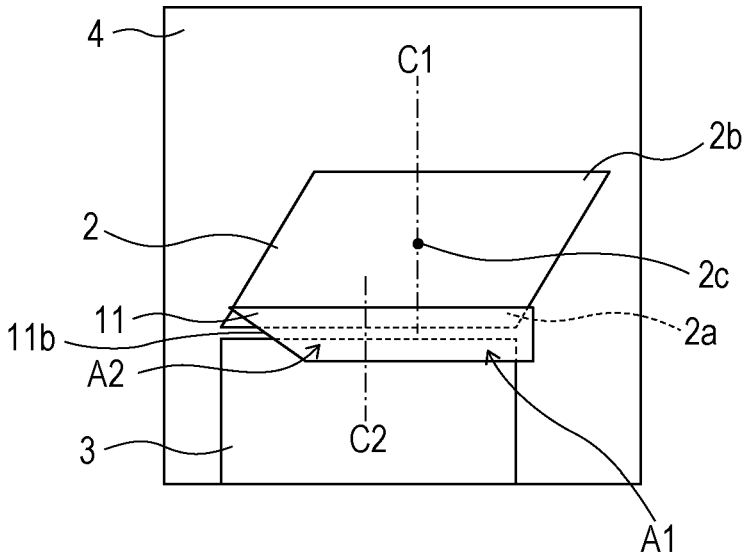
FIG. 5A is a plan view a modification of the liquid ejection head shown in FIGS. 1A to 1C.

FIG. 5A shows a first modification of this embodiment. In this modification, the sealing member 11 has a rectangular planar shape having a cutout portion 11*b*. Specifically, the cutout portion (a recessed portion) 11*b* is provided at an end of the sealing member 11 in the area A2 through which the perpendicular C1 does not pass, so that the volume of the area A1 through which the perpendicular C1 passes is larger than the volume of the area A2 through which the perpendicular C1 does not pass. This provides a high misalignment prevention effect like the configuration shown in FIGS. 1A to 1C and FIG. 3.

Figure 5B:
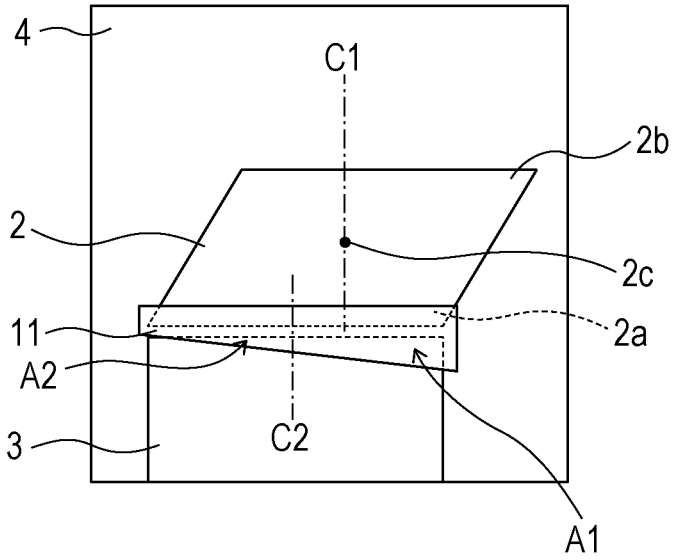
FIG. 5B is a plan view another modification of the liquid ejection head shown in FIGS. 1A to 1C.

FIG. 5B shows a second modification of this embodiment. In this modification, the sealing member 11 has a lateral trapezoidal planar shape increasing in size from the area A2 through which the perpendicular C1 does not pass toward the area A1 through which the perpendicular C1 passes. With this configuration, the volume of the area A1 through which the perpendicular C1 passes can be sufficiently larger than that of the area A2 through which the perpendicular C1 does not pass, so that the effect of preventing misalignment due to the rotation can easily be obtained without the large protruding portion 11*a* or the recessed portion 11*b*.

Also in these modifications, in the configuration in which the part of the sealing member 11 covering the first side portion 2*a* of the recording element substrate 2 is divided into two areas by the perpendicular C1, the volumes of the two areas may be equal or the difference therebetween may be small like the configuration shown in FIG. 4. The sealing member 11 may be provided with a protruding portion on one area and a recessed portion on the other area so that the volumes thereof differ from each other.

Second Embodiment

Next, a second embodiment of the present invention shown in FIG. 6A will be described. This embodiment includes a deformation preventing member 12 made of resin for covering the second side portion 2*b* of the recording element substrate 2, in addition to the sealing member 11 for protecting the connecting members 10 provided between the first side portion 2*a* of the recording element substrate 2 and the electrical wiring substrate 3. The deformation preventing member 12 may be made of a resin material or the same resin as that of the sealing member 11. The technical significance of the deformation preventing member 12 will be described hereinbelow.

Another cause of misalignment of the recording element substrate 2 in the known liquid ejection head 1 may be concentration of stress due to the cure shrinkage of the sealing member 11. PCT Japanese Translation Patent Publication No. 2010-521343 discloses the configuration in which the electrical wiring substrate 3 is disposed only at a position facing the first side portion 2*a* of the recording element substrate 2 to achieve size reduction and so on of the liquid ejection head 1. In this configuration, the sealing member 11 for protecting the connecting members 10 is provided only on the first side portion 2*a*, as shown in FIG. 2. As described above, the sealing member 11 is made of a thermosetting resin, which is thermally cured after being applied and is thereafter cooled and shrunk. A stress due to the shrinkage is concentrated on the first side portion 2*a* of the recording element substrate 2 on which the sealing member 11 is provided. In contrast, the second side portion 2*b* of the recording element substrate 2 is not acted upon by stress. Since the stress is concentrated only on the first side portion 2*a* of the recording element substrate 2, and no stress acts on the second side portion 2*b*, the stress concentrated on the first side portion 2*a* may move or deform the recording element substrate 2.

Figure 6A:
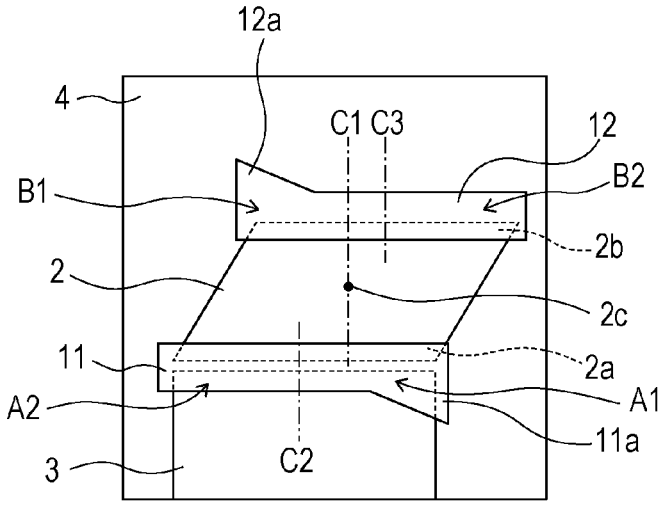
FIG. 6A is a plan view of a liquid ejection head according to a second embodiment of the present invention.

Thus, in this embodiment, the deformation preventing member 12 is disposed on the second side portion 2*b* of the recording element substrate 2, as shown in FIG. 6A. The second side portion 2*b* is provided with no electrical connecting member. Thus, the deformation preventing member 12 is provided as a dummy sealing member not for sealing electrical connecting members. When the sealing member 11 provided on the first side portion 2*a* is thermally cured, the deformation preventing member 12 is also thermally cured at the same time and is then cooled. Accordingly, when a stress is applied to the first side portion 2*a* due to the cure shrinkage of the sealing member 11, the second side portion 2*b* is also stressed due to the cure shrinkage of the deformation preventing member 12 at the same time. The stress acting on the first side portion 2*a* due to the cure shrinkage of the sealing member 11 and the stress acting on the second side portion 2*b* due to the cure shrinkage of the deformation preventing member 12 are balanced, so that deformation and misalignment of the recording element substrate 2 are prevented. In this way, this embodiment can achieve size reduction by using only the first side portion 2*a* of the recording element substrate 2 for electrical connection and can reduce misalignment by eliminating concentration of stress on the first side portion 2*a* of the recording element substrate 2. This allows misalignment of the landing positions of liquid ejected from the liquid ejection head 1. Using the liquid ejection head 1 in an ink-jet printer allows good printing and provides high recording quality. The deformation preventing member 12 may be made of the same material as that of the sealing member 11, while it may be made of another material having a property close thereto in the coefficient of linear expansion, the coefficient of elasticity, and the like.

The deformation preventing member 12 may have a rectangular planar shape (not shown). However, as shown in FIG. 6A, if the part of the deformation preventing member 12 covering the second side portion 2*b* of the recording element substrate 2 is divided by a deformation-preventing-member center line C3, the volume of an area B1 through which the perpendicular C1 passes may be larger than the volume of an area B2 through which the perpendicular C1 does not pass. The deformation-preventing-member center line C3 here is a line passing through the center of the part on the side of the second side portion 2*b* of the recording element substrate 2 and covered with the deformation preventing member 12 and extending parallel to the perpendicular C1.

In the configuration shown in FIG. 6A, the sealing member 11 has a rectangular planar shape including the protruding portion 11*a*, similarly to the configuration shown in FIGS. 1A to 1C and FIG. 3, and the deformation preventing member 12 also has a rectangular planer shape including a protruding portion 12*a*. With this configuration, the same misalignment preventing effect as that of the configuration of the first embodiment in which the sizes of the areas A1 and A2 covering the first side portion 2*a* of the recording element substrate 2 differ, shown in FIG. 3, can be obtained using the deformation preventing member 12. That is, this configuration provides a greater misalignment preventing effect by preventing concentration of stress on the first side portion 2*a* of the recording element substrate 2 and by reducing generation of a rotational force about the center of gravity 2*c* of the recording element substrate 2 in both of the sealing member 11 and the deformation preventing member 12. In other words, as compared with a configuration without the deformation preventing member 12, even if the protruding portion 11*a* of the sealing member 11 is decreased in size, a sufficient rotation preventing effect can be obtained by providing the protruding portion 12*a* also in the deformation preventing member 12. The sealing member 11 and the deformation preventing member 12 may be symmetrical about a point (rotationally symmetric) with the center of gravity 2*c* of the recording element substrate 2 as its symmetric point.

Figure 6B:
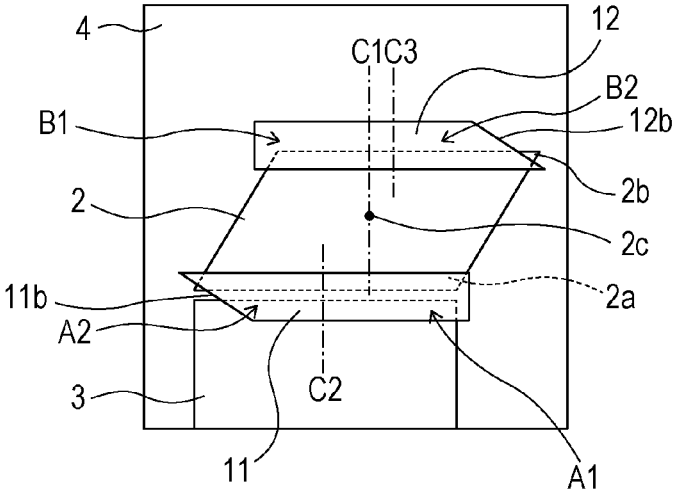
FIG. 6B is a plan view of a modification of the liquid ejection head according to the second embodiment.

FIG. 6B shows a modification of this embodiment. In this modification, the sealing member 11 has the cutout portion 11*b*, like the configuration shown in FIG. 5A, and the deformation preventing member 12 also has a cutout portion 12*b*. Thus, of the two areas B1 and B2 obtained by dividing the part of the deformation preventing member 12 covering the second side portion 2*b* of the recording element substrate 2 by the deformation-preventing-member center line C3, the area B1 through which the perpendicular C1 passes is larger in volume than the area B2 through which the perpendicular C1 does not pass. This provides a high misalignment preventing effect, like the configuration shown in FIG. 6A, while minimizing the sealing member 11 and the deformation preventing member 12. The sealing member 11 and the deformation preventing member 12 may be symmetrical about a point (rotationally symmetric) with the center of gravity 2*c* of the recording element substrate 2 as its symmetric point.

Figure 6C:
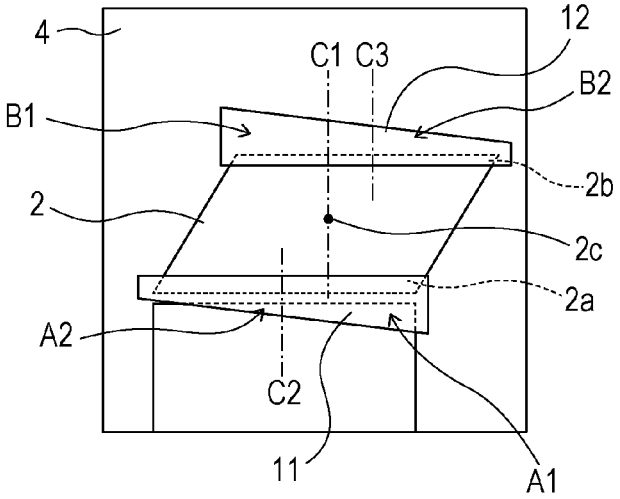
FIG. 6C is a plan view of another modification of the liquid ejection head according to the second embodiment.

FIG. 6C shows another modification of this embodiment. In this modification, the sealing member 11 has a lateral trapezoidal shape whose volume increases continuously, like the configuration shown in FIG. 5B. The deformation preventing member 12 has a lateral trapezoidal shape whose volume increases continuously in the opposite direction to that of the sealing member 11 from the area B2 through which the perpendicular C1 does not pass toward the area B1 through which the perpendicular C1 passes. Thus, of the part of the deformation preventing member 12 covering the second side portion 2*b* of the recording element substrate 2, the area B1 through which the perpendicular C1 passes is larger in volume than the area B2 through which the perpendicular C1 does not pass. This modification also offers a high misalignment preventing effect like the configurations shown in FIGS. 6A and 6B. The sealing member 11 and the deformation preventing member 12 may be symmetrical about a point (rotationally symmetric) with the center of gravity 2*c* of the recording element substrate 2 as its symmetric point.

Also in this embodiment, in the configuration in which the part of the sealing member 11 covering the first side portion 2*a* of the recording element substrate 2 is divided into two areas by the perpendicular C1, the volumes of the two areas may be equal or the difference therebetween may be small like the configuration shown in FIG. 4. Furthermore, in the configuration in which the part of the deformation preventing member 12 covering the second side portion 2*b* of the recording element substrate 2 is divided into two areas by the perpendicular C1 passing through the center of gravity 2*c* of the recording element substrate 2, the volumes of the two areas may be equal, or the difference therebetween may be small. Also in this embodiment, the deformation preventing member 12 may be provided on the second side portion 2*b* so that the rotational force is smaller than that when the sealing member 11 is provided on the first side portion 2*a* of the recording element substrate 2 as in the first embodiment.

Third Embodiment

Figure 7A:
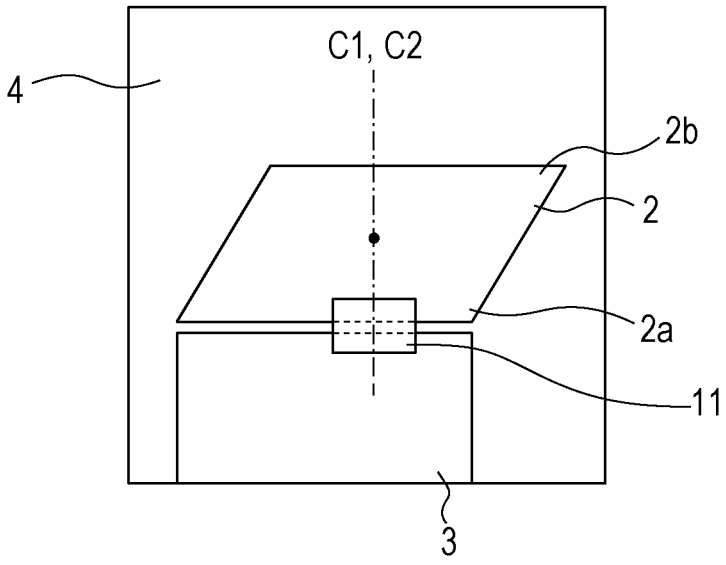
FIG. 7A is a plan view of a liquid ejection head according to a third embodiment of the present invention.

A third embodiment of the present invention shown in FIG. 7A will be described.

In the first and second embodiments, the length of the sealing member 11 extending along the side of the recording element substrate 2 adjacent to the first side portion 2*a* is substantially the same as the length of the sides thereof. However, this embodiment has a compact sealing member 11 shorter than the sides, as shown in FIG. 7A. In this configuration, the connecting members 10 (see FIGS. 1A to 1C) for electrically connecting the recording element substrate 2 and the electrical wiring substrate 3 are densely and partially disposed, and the sealing member 11 of a minimum size necessary for covering the connecting members 10 is provided. The sealing member 11 is disposed at a position biased in the direction along the side adjacent to the first side portion 2*a* of the recording element substrate 2 so that the perpendicular C1 passing through the center of gravity 2*c* of the recording element substrate 2 and the sealing-member center line C2 are substantially aligned. When the perpendicular C1 passing through the center of gravity 2*c* of the recording element substrate 2 and the sealing-member center line C2 are aligned, as described above, a force that rotates the recording element substrate 2 about the center of gravity 2*c* does not substantially act, so that misalignment can be suppressed. That is, in this embodiment, the perpendicular C1 passing through the center of gravity 2*c* of the recording element substrate 2 and the sealing-member center line C2 are substantially aligned to reduce the misalignment. Thus, the sealing member 11 is disposed at a position off the center of the side in the direction along the side of the recording element substrate 2 adjacent to the first side portion 2*a*, while the sealing member 11 is reduced in size.

Figure 7B:
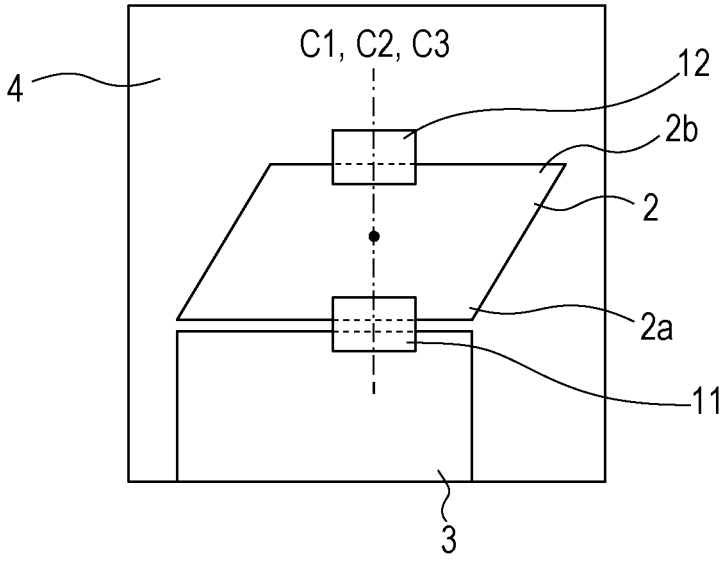
FIG. 7B is a plan view of a modification of the liquid ejection head according to the third embodiment.

In a modification shown in FIG. 7B, the deformation preventing member 12 for covering the second side portion 2*b* of the recording element substrate 2 is provided in addition to the compact sealing member 11 covering the first side portion 2*a*, as described above. The deformation preventing member 12 has the same size as that of the sealing member 11. A deformation-preventing-member center line C3 is substantially aligned with the perpendicular C1 passing through the center of gravity 2*c* of the recording element substrate 2 and the sealing-member center line C2. The configuration reduces the rotational force of the sealing member 11 acting on the recording element substrate 2 and prevents a stress from concentrating on the first side portion 2*a*. The configuration also reduces the rotational force of the deformation preventing member 12 acting on the recording element substrate 2. This further enhances the effect of preventing misalignment.

Although the deformation preventing member 12 may be made of the same material as that of the sealing member 11, it may be made of another material having a property close thereto in the coefficient of linear expansion, the coefficient of elasticity, or the like. In the case where electrically connecting members 10 between the irregular-shaped recording element substrate 2, such as a parallelogram, and the electrical wiring substrate 3 and the sealing member 11 are provided only in part on the side of the recording element substrate 2, as in this embodiment, the configuration of this embodiment is advantageous. In this case, the lines C1 and C2 do not necessarily have to be aligned; the virtual line C1 passing through the center of gravity 2*c* of the recording element substrate 2 may advantageously intersect the area in which the sealing member 11 is provided to reduce the rotational force. The configuration of this embodiment is effective in a liquid ejection head in which the side of an area, of the side adjacent to the first side portion of the recording element substrate, in which the sealing member 11 is provided is shorter than that of an area in which the sealing member 11 is not provided, as shown in FIGS. 7A and 7B.

Fourth Embodiment

The first to third embodiments relate to serial-type compact liquid ejection heads, while this embodiment adopts a long line head corresponding to the length of a recording medium.

Figure 8A:
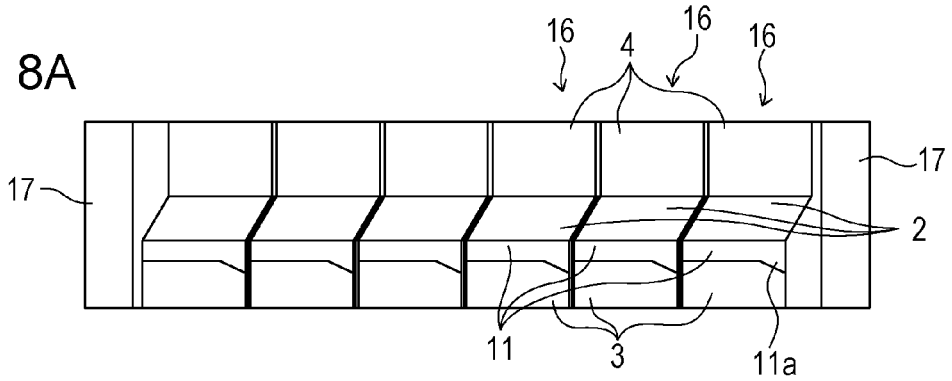
FIG. 8A is a plan view of a liquid ejection head according to a fourth embodiment of the present invention.
Figure 8B:
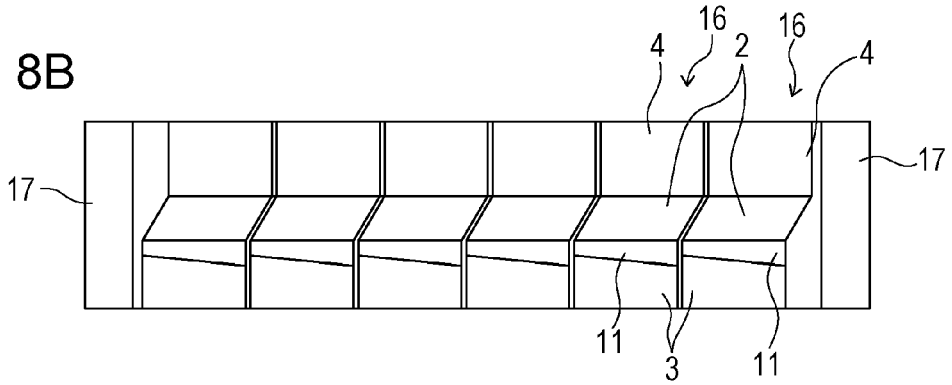
FIG. 8B is a plan view of a modification of the liquid ejection head according to the fourth embodiment.

In configurations shown in FIGS. 8A and 8B, a plurality of units (head modules) 16 in each of which the recording element substrate 2, the electrical wiring substrate 3, the connecting members 10, and the sealing member 11 are disposed on the support member 4 are placed in a line on one long supporting member 17. The plurality of recording element substrates 2 are closely placed in a straight line. The configuration of the units may adopt that of any of the first to third embodiments. In the configuration shown in FIG. 8A, a plurality of units 16 each including the sealing member 11 having the protruding portion 11*a*, as in the configuration shown in FIGS. 1A to 1C and FIG. 3, are lined. In the configuration shown in FIG. 8B, a plurality of units 16 each including the lateral trapezoidal sealing member 11, as in the configuration shown in FIG. 5B, are lined. The detailed configuration of the units 16 is not limited to those described in FIGS. 8A and 8B; any of the configurations shown in FIGS. 1A to 7B may be adopted. In a modification shown in FIG. 8C, a plurality of support members 4 are closely placed on one long supporting member 17 in a line, and one long sealing member 18 is provided across all of the support members 4. The sealing member 18 collectively covers the first side portions 2*a* of all the recording element substrates 2 and the opposing portions of all the electrical wiring substrates 3. Since the first side portions 2*a* of the plurality of recording element substrates 2 are covered with one sealing member 18, this configuration has the advantage that it is difficult for the individual recording element substrates 2 to independently move (rotate), in addition to the advantage of the first embodiment. Furthermore, since the sealing member 18 can be formed in one process, it is easy to form it. Furthermore, since variation in misalignment of the individual recording element substrates 2 is small, it is easy to adjust the relative position of the recording element substrates 2, leading to easy adjustment.

Figure 8C:
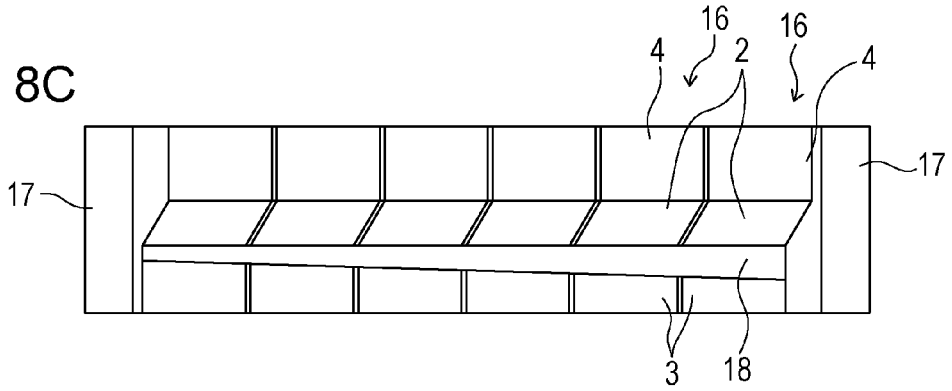
FIG. 8C is a plan view of another modification of the liquid ejection head according to the fourth embodiment.
Figure 8D:
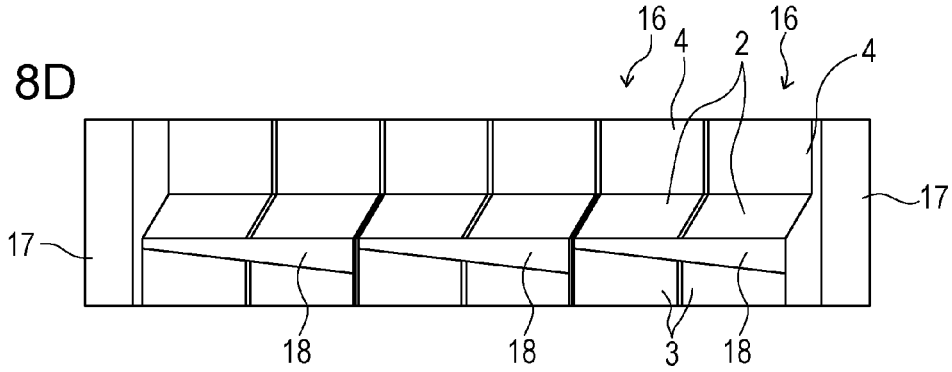
FIG. 8D is a plan view of another modification of the liquid ejection head according to the fourth embodiment.

As in another modification shown in FIG. 8D, one sealing member 18 may be provided for each of groups each consisting of at least two adjacent recording element substrates 2. This has the effect of reducing independent movement (rotation) of individual recording element substrates 2 to some extent, like the configuration shown in FIG. 8C.

In the configuration shown in FIG. 8C, all the recording element substrates 2 are collectively covered with one sealing member 18. In the configuration shown in FIG. 8D, the recording element substrates 2 are grouped into a plurality of groups, each of which is provided with one sealing member 18. Which of these configurations is to be selected may be determined on the basis of, for example, the size of the entire liquid ejection head 1, in consideration of the ease of manufacture and the effect of preventing misalignment.

Also in this embodiment, in the configuration in which the parts of the sealing members 11 and 18 covering the recording element substrates 2 and the electrical wiring substrates 3 are each divided into two areas by the perpendicular C1, the volumes of the two areas may be equal, or the difference between the volumes may be small.

Fifth Embodiment

In this embodiment, a line head in which a plurality of units 16 are placed in a line, as in the fourth embodiment, is provided with the deformation preventing member 12, as in the second embodiment.

Figure 9A:
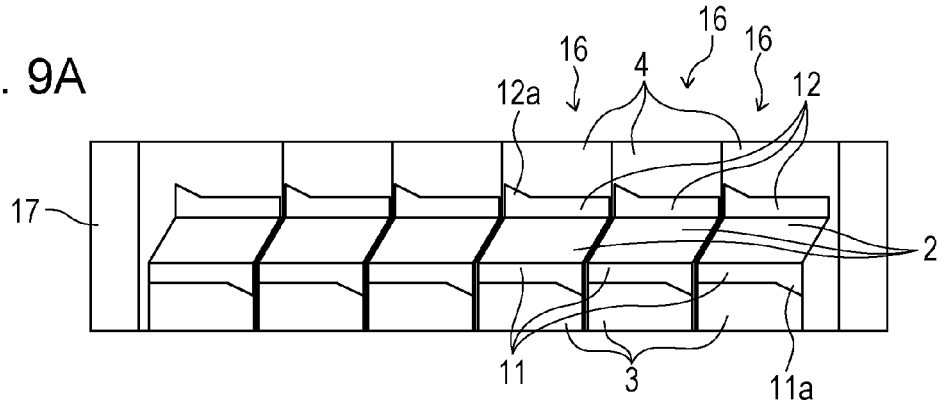
FIG. 9A is a plan view of a liquid ejection head according to a fifth embodiment of the present invention.

In a configuration shown in FIG. 9A, the units 16 each include one recording element substrate 2, one electrical wiring substrate 3, connecting members 10, one sealing member 11, and one deformation preventing member 12, like the configuration shown in FIG. 8A. The first side portion 2*a* of the recording element substrate 2 is covered with the sealing member 11, and the second side portion 2*b* is covered with the deformation preventing member 12. Another configuration is possible (not shown) in which a deformation preventing member covering the second side portion 2*b* of the recording element substrate 2 is added to the configuration shown in FIG. 8B.

Figure 9B:
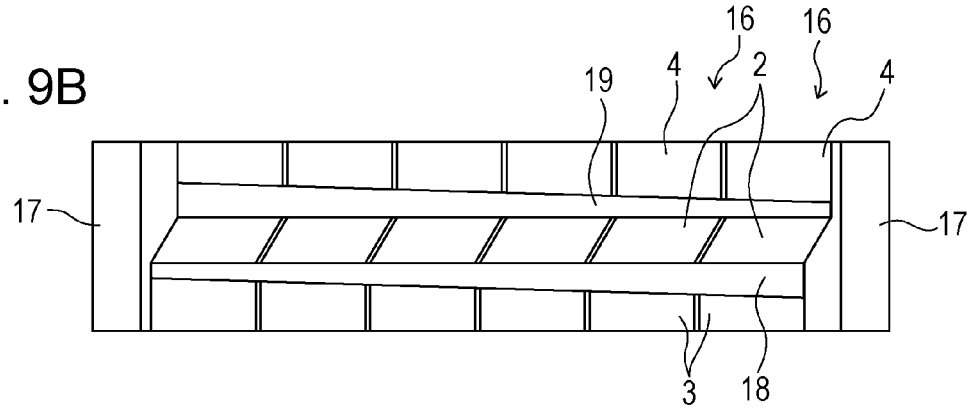
FIG. 9B is a plan view of a modification of the liquid ejection head according to the fifth embodiment.

In a configuration shown in FIG. 9B, one long sealing member 18 and one deformation preventing member 19 are provided across all of the plurality of support members 4 arrayed on one long supporting member 17, like the configuration shown in FIG. 8C. The sealing member 18 collectively covers the first side portions 2*a* of all the recording element substrates 2 and the opposing portions of all the electrical wiring substrates 3. Likewise, the long deformation preventing member 19 collectively covers the second side portions 2*b* of all the recording element substrates 2.

Figure 9C:
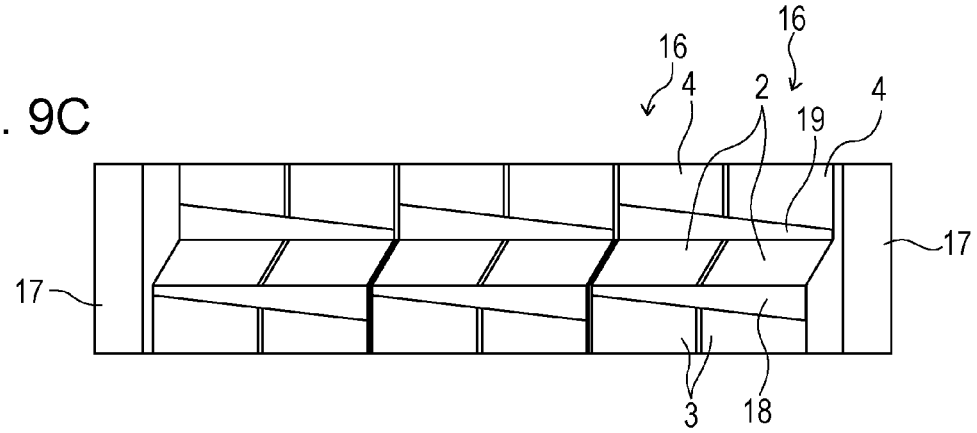
FIG. 9C is a plan view of another modification of the liquid ejection head according to the fifth embodiment.

In a configuration shown in FIG. 9C, one sealing member 18 and one deformation preventing member 19 are provided for each of groups each consisting of at least two adjacent recording element substrates 2, like the configuration shown in FIG. 8D.

In these configurations, the deformation preventing members 12 and 19 are provided so as to cover the second side portions 2*b* of the recording element substrates 2. Thus, as described in the second embodiment, a stress is not concentrated only on the first side portions 2*a* of the recording element substrates 2 when the sealing members 11 and 18 and the deformation preventing members 12 and 19 are hardened and shrunk, and the stress acting on the first side portions 2*a* and the stress acting on the second side portions 2*b* are balanced. This enhances the effect of preventing the misalignment of the recording element substrates 2.

Also in this embodiment, in the configuration in which the parts of the sealing members 11 and 18 covering the recording element substrates 2 and the electrical wiring substrates 3 are each divided into two areas by the perpendicular C1, the volumes of the two areas may be equal, or the difference between the volumes may be small. Furthermore, if the parts of the deformation preventing members 12 and 19 covering the second side portions 2*b* of the recording element substrates 2 are each divided into two areas by the perpendicular C1 passing through the center of gravity 2*c* of each recording element substrate 2, the volumes of the two areas may be equal, or the difference between the volumes may be small.

As described above, according to some embodiments of the present invention, misalignment of the recording element substrates of the liquid ejection head can be reduced, and thus the accuracy of landing positions of ejected droplets is increased. Thus, adopting the liquid ejection head in an ink-jet printer provides stable high recording quality also in high-speed printing.

Furthermore, for a line head in which a plurality of recording element substrates are lined, misalignment of the individual recording element substrates can be reduced. Furthermore, the relative misalignment of the recording element substrates can be reduced and the relative position of the recording element substrates can easily be adjusted, and thus the efficiency of the operation can be enhanced. This prevents streaks and variations in recorded images due to the relative misalignment of the recording element substrates, thereby preventing degradation of recording quality. The configuration of the above embodiments in which the electrical wiring substrate 3 extends linearly from the first side portion of the recording element substrate 2 is given for illustration but is not intended to limit the present invention. For example, the present invention can be applied to a liquid ejection head with a configuration in which the electrical wiring substrates 3 each have an opening, in which the recording element substrate 2 is disposed and is electrically connected to the inner rim of the opening of the electrical wiring substrate.

Accordingly, according to some embodiments of the present invention, misalignment of the recording element substrates can be prevented by reducing generation of a rotational force due to the cure shrinkage of the sealing member in the recording element substrates. This can reduce a decrease in the landing accuracy of liquid ejected from the liquid ejection head. Accordingly, using the liquid ejection head in an ink-jet printer allows high-quality printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-099418, filed May 13, 2014 and No. 2015-084378, filed Apr. 16, 2015, which are hereby incorporated by reference herein in their entirety.

What is claimed is:

1. A liquid ejection head comprising:

a recording element substrate including an electrode at a first side portion;

an electrical wiring substrate including an electrode terminal and opposed to the first side portion of the recording element substrate;

a connecting member connecting the electrode provided at the first side portion of the recording element substrate and the electrode terminal provided at the electrical wiring substrate; and a sealing member provided between the first side portion of the recording element substrate and the electrical wiring substrate so as to cover the connecting member, wherein a perpendicular and a sealing-member center line are out of alignment in a direction along a side of the recording element substrate adjacent to the first side portion, the perpendicular passing through a center of gravity of the recording element substrate and orthogonal to the side, and the sealing-member center line passing through a center of a part on the side covered with the sealing member in the direction along the side and extending parallel to the perpendicular; and of two areas of a part of the sealing member covering the first side portion of the recording element substrate, the two areas being divided by the sealing-member center line, an area through which the perpendicular passes has a larger volume than that of an area through which the perpendicular does not pass.

2. The liquid ejection head according to claim 1, wherein the recording element substrate includes an ejection port for ejecting liquid and a recording element that generates energy for ejecting the liquid through the ejection port; and the electrode is electrically connected to the recording element.

3. The liquid ejection head according to claim 1, wherein the recording element substrate has a parallelogram planar shape.

4. The liquid ejection head according to claim 1, wherein the sealing member is formed of a thermosetting resin.

5. The liquid ejection head according claim 1, further comprising a deformation preventing member provided so as to cover a second side portion of the recording element substrate opposite to the first side portion.

6. The liquid ejection head according to claim 5, wherein the deformation preventing member is formed of a thermosetting resin.

7. The liquid ejection head according to claim 5, wherein the sealing member and the deformation preventing member are formed of a same material.

8. The liquid ejection head according to claim 5, wherein the sealing member and the deformation preventing member are symmetric about the center of gravity of the recording element substrate.

9. The liquid ejection head according to claim 1, wherein the at least one recording element substrate comprises a plurality of recording element substrates disposed in a straight line; and the sealing member is provided for each of the recording element substrates.

10. The liquid ejection head according to claim 1, wherein the recording element substrate is one of recording element substrates disposed in a straight line; and the sealing member continuously covers the first side portions of at least two adjacent recording element substrates.

11. The liquid ejection head according to claim 1, wherein a plurality of the recording element substrates are disposed in a straight line, and the sealing member continuously covers the first side portions of all the recording element substrates.

12. A liquid ejection head comprising:

a recording element substrate including an electrode at a first side portion;

an electrical wiring substrate including a wire line;

a connecting portion connecting the electrode of the recording element substrate and the wire line of the electrical wiring substrate; and a sealing material provided between the first side portion of the recording element substrate and the electrical wiring substrate so as to cover the connecting portion, wherein a first line and a second line are out of alignment in a direction along a side of the recording element substrate adjacent to the first side portion, the first line passing through a center of gravity of the recording element substrate and orthogonal to the side, and a second line passing through a center of a part on the side covered with the sealing material and extending parallel to the first line; and of two areas of part of the sealing material covering the first side portion of the recording element substrate, the two areas being divided by the second line, a first area on the first line side has a larger volume than that of a second area opposite to the first line side.

13. The liquid ejection head according to claim 12, wherein the recording element substrate has a parallelogram planar shape.

14. The liquid ejection head according to claim 12, wherein the sealing material is a thermosetting resin.

15. The liquid ejection head according to claim 12, wherein the recording element substrate has no electrode at a second side portion opposite to the first side portion.

16. The liquid ejection head according to claim 15, wherein the second side portion is covered with a thermosetting resin member.

17. The liquid ejection head according to claim 12, wherein the first area of the sealing material has a protruding portion.

18. A liquid ejection head comprising:

a recording element substrate including an electrode at a first side portion;

an electrical wiring substrate including a wire line;

a connecting portion connecting the electrode of the recording element substrate and the wire line of the electrical wiring substrate; and a sealing material provided between the first side portion of the recording element substrate and the electrical wiring substrate so as to cover the connecting portion, wherein the sealing material is provided in a part of a side of the recording element substrate adjacent to the first side portion; and a line passing through a center of gravity of the recording element substrate and orthogonal to the side intersects an area in which the sealing material is provided.

19. The liquid ejection head according to claim 18, wherein, of the side, the area in which the sealing material is provided is shorter than an area in which the sealing material is not provided.

20. The liquid ejection head according to claim 18, wherein the recording element substrate has a parallelogram planar shape.

* * * * *